US008337005B2

(12) United States Patent
Okubo

(10) Patent No.: US 8,337,005 B2
(45) Date of Patent: Dec. 25, 2012

(54) LIQUID EJECTING HEAD, LIQUID EJECTING HEAD UNIT AND LIQUID EJECTING APPARATUS

(75) Inventor: Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/087,295

(22) Filed: Apr. 14, 2011

(65) Prior Publication Data

US 2011/0254892 A1 Oct. 20, 2011

(30) Foreign Application Priority Data

Apr. 16, 2010 (JP) ..... 2010-094769

(51) Int. Cl.
*B41J 2/175* (2006.01)

(52) U.S. Cl. ..... 347/93

(58) Field of Classification Search ..... 347/92
See application file for complete search history.

(56) References Cited

U.S. PATENT DOCUMENTS 6,267,251 B1 * 7/2001 Sullivan ..... 210/488
2009/0213199 A1 * 8/2009 Owaki et al. ..... 347/93

* cited by examiner

*Primary Examiner* — Julian Huffman
(74) *Attorney, Agent, or Firm* — Kilpatrick Townsend & Stockton LLP

(57) ABSTRACT

A liquid ejecting head includes a head main body, an ink supply needle, a cartridge case, a filter which is nipped between the first ink supply path and the second ink supply path, an integral molding portion which integrally molds and bonds the ink supply needle and the cartridge case, and a rib which is arranged so as to extend into the second ink supply path continuously from a wall of the cartridge case along a line passing through a center of the filter in the direction perpendicular to the direction in which warpage of the integral molding portion is larger.

14 Claims, 11 Drawing Sheets

LIQUID EJECTING HEAD, LIQUID EJECTING HEAD UNIT AND LIQUID EJECTING APPARATUS

The entire disclosure of Japanese Patent Application No: 2010-094769, filed Apr. 16, 2010 are expressly incorporated by reference herein.

BACKGROUND

1. Technical Field

The present invention relates to a liquid ejecting head, a liquid ejecting head unit, and a liquid ejecting apparatus, in particular, relates to an ink jet recording head and an ink jet recording apparatus which discharge ink as liquid.

2. Related Art

In an ink jet recording head as a typical example of a liquid ejecting head, in general, ink is supplied from an ink cartridge as a liquid storage unit which is filled with ink to a head main body through an ink supply needle as an ink supply member and an ink supply path. The ink supply needle is inserted into the ink cartridge in a detachable manner or is arranged on the tip of a supply pipe such as a tube extended from the ink cartridge. The ink supply path is formed in a supply member such as a cartridge case by which the ink cartridge is held. Then, ink supplied to the head main body is discharged through a nozzle by driving a pressure generation unit such as a piezoelectric element provided on the head main body.

An ink jet recording head in which a filter is provided in order to eliminate discharge failure such as missing dot due to air bubbles or the like has been known as such ink jet recording head (for example, see JP-A-2009-220567). The filter is provided between the ink supply needle inserted into the ink cartridge and the cartridge case so as to remove air bubbles, dusts, and the like in ink.

However, in the configuration described in JP-A-2009-220567, in particular, when a filter is arranged in a flow path with an integral molding system in which double molding is performed so as to bond two parts to each other, there arises the following risk. That is, the filter is strained due to the difference in linear expansion coefficients between the two parts at the time of contraction of a molded resin to be partially swelled in some case. In this case, the filter wrinkles and sticks to an inner wall surface of the flow path at a downstream side of the filter or air bubbles easily accumulate between the wrinkled filter and the inner wall surface of the flow path at the downstream side of the filter. This causes a problem in that an effective area of the filter (area of on the filter through which liquid passes) is reduced.

It is to be noted that the above problem is caused not only in the ink jet recording head but also in a liquid ejecting head which ejects liquids other than ink.

SUMMARY

An advantage of some aspects of the invention is to provide a liquid ejecting head, a liquid ejecting head unit, and a liquid ejecting apparatus which can prevent an effective area of a filter from being reduced.

A liquid ejecting head according to an aspect of the invention includes a head main body which ejects liquid supplied from a liquid storage unit through a liquid supply path, a first supply member on which a first liquid supply path constituting a part of the liquid supply path is provided, a second supply member on which a second liquid supply path communicating with the first liquid supply path to constitute a part of the liquid supply path is provided and which supplies the liquid to the head main body, a filter which is nipped between the first liquid supply path and the second liquid supply path, an integral molding portion which integrally molds and bonds the first supply member and the second supply member, and a rib which is arranged so as to extend into the second liquid supply path continuously from a wall of the second supply member along a line passing through the center of the filter in the direction perpendicular to the direction in which warpage of the integral molding portion is larger.

According to the aspect of the invention, the rib is provided, so that deformation of the filter can be restricted by making the surface of the filter at the side of the second liquid supply path abut against the rib. In addition, according to the aspect of the invention, the rib is provided along a line passing through the center of the filter in the direction perpendicular to the direction in which warpage of the integral molding portion is larger. Therefore, the deformation of the filter can be restricted more effectively.

This feature will be described in further detail. FIG. 12 is a descriptive view conceptually illustrating a filter 33. According to the aspect of the invention, the integral molding portion is formed by integrally molding and bonding the first supply member and the second supply member. Therefore, a molded resin contracts at the time of cooling, so that the filter 33 nipped between the first liquid supply path and the second liquid supply path is compressed. Accordingly, the filter 33 expands to an upper side or a lower side at a center free portion and is strained at the time of the expansion. Therefore, partial recesses C1, C2 are formed on specific portions of the filter 33 in some case. When liquid flows at high pressure in a state where the recesses C1, C2 are formed, the filter 33 is deformed originating from the recesses C1, C2 so as to generate large swelling. This causes the second liquid supply path to become narrower.

It has been found that a specific relationship is established between generation positions of the recesses C1, C2 and swelling direction originating from the recesses C1, C2. As illustrated in FIG. 12, when a stress (warpage) in the X-axis direction is larger than a stress in the Y-axis direction perpendicular to the X-axis direction, the recesses C1, C2 tend to be formed on ends of the filter 33 in the Y-axis direction in which the stress is smaller. Accordingly, in such a case, a rib is arranged along a line passing through the center of the filter 33 in the Y-axis direction perpendicular to the X-axis direction in which warpage is larger. Therefore, the surface of the filter 33 at the side of the second liquid supply path can be abutted against the upper surface of the rib. As a result, deformation of the filter can be restricted.

That is to say, according to the aspect of the invention, the deformation of the filter originating from the recesses C1, C2 can be prevented by the rib. As a result, a narrow portion of the second liquid supply path, which is formed by a portion of the filter which is lowered to the side of the second liquid supply path due to generation of strain on the molded part, can be prevented from being generated, whereby discharge performance of air bubbles can preferably be maintained.

Meanwhile, it is preferable that openings of the flow path on the second liquid supply path, which communicates with the head main body, may be formed at both sides of the rib. In this case, liquid can preferably be discharged through the plurality of openings. Further, it is preferable that the opening may be formed at the center of the rib. In this case, ink can be collected to one opening at the center from both sides of the rib and predetermined supply of liquid through the second liquid supply path can be performed appropriately. Furthermore, it is preferable that the rib may be provided from the wall to an edge of the opening. In this case, the rib is not formed on the opening. Therefore, liquid is discharged into the second liquid supply path through the opening smoothly.

It is desirable that an upper surface of the rib be formed so as to be flush with the surface of the filter at the side of the second liquid supply path. The filter does not go lower than the position of the upper surface of the rib. Further, in this case, a posture of the filter when mounted is kept as long as possible. Therefore, the filter can sufficiently fulfill the original function thereof while preventing air bubbles from being generated.

In a liquid ejecting head unit according to another aspect of the invention, it is preferable that the liquid ejecting head unit include a plurality of the above liquid ejecting heads.

According to the aspect of the invention, the same actions and effects as those described above can be obtained in the unitized head.

In a liquid ejecting apparatus according to still another aspect of the invention, it is preferable that the liquid ejecting apparatus include the above liquid ejecting head or the above liquid ejecting head unit.

According to the aspect of the invention, the liquid ejecting apparatus includes the liquid ejecting head or the liquid ejecting head unit in which the deformation of the filter is suppressed so that air bubbles are not easily retained and the filter does not easily stick to an inner wall surface. Therefore, in the liquid ejecting apparatus, an effective area of the filter can be made larger, whereby desired liquid ejecting characteristics can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

First Embodiment

Figure 1:
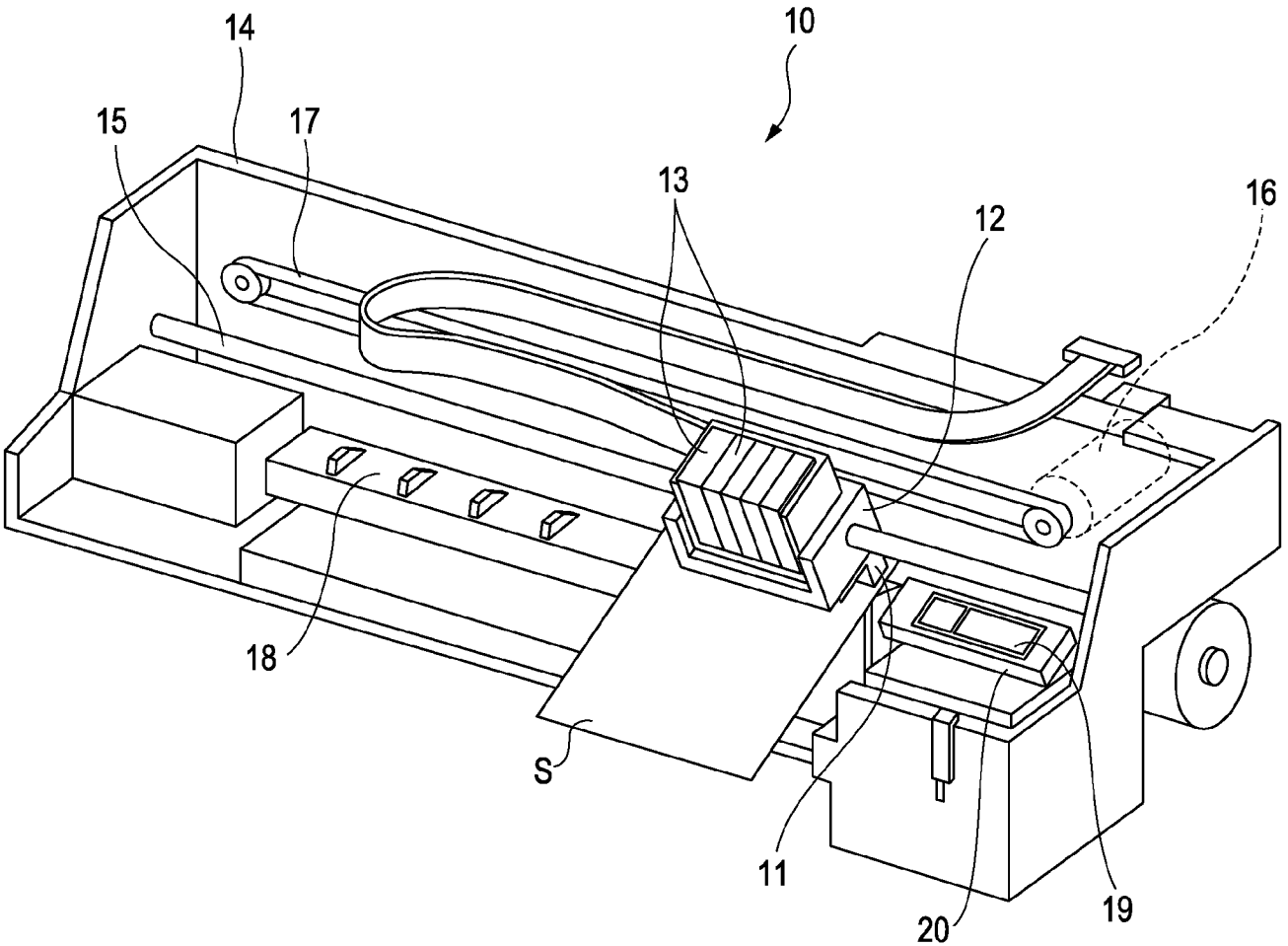
FIG. 1 is a schematic perspective view illustrating a recording apparatus according to a first embodiment.

FIG. 1 is a schematic perspective view illustrating an ink jet recording apparatus as an example of a liquid ejecting apparatus according to the first embodiment of the invention. As illustrated in FIG. 1, an ink jet recording apparatus 10 according to the invention includes an ink jet recording head (hereinafter, also referred to as recording head) 11 fixed to a carriage 12. The ink jet recording head 11 is an example of a liquid ejecting head which discharges ink droplets. In the ink jet recording apparatus 10, each of ink cartridges 13 as examples of liquid storage units is fixed to the ink jet recording head 11 in a detachable manner. Inks of a plurality of different colors such as black (B), light black (LB), cyan (C), magenta (M), and yellow (Y) are stored in the ink cartridges 13, respectively.

The carriage 12 on which the recording head 11 is mounted is provided so as to be movable in an axial direction of a carriage shaft 15. The carriage shaft 15 is attached to an apparatus main body 14. Further, driving force of a driving motor 16 is transmitted to the carriage 12 through a plurality of gears (not shown) and a timing belt 17 so that the carriage 12 is moved along the carriage shaft 15. On the other hand, a platen 18 is provided on the apparatus main body 14 along the carriage shaft 15. A recording medium S such as a sheet fed by a sheet feeding device (not shown) or the like is transported on the platen 18.

Further, a capping device 20 is provided at a position corresponding to a home position of the carriage 12, that is, in the vicinity of one end of the carriage shaft 15. The capping device 20 has a cap member 19 which seals a nozzle formation surface of the recording head 11. By sealing the nozzle formation surface on which nozzle openings are formed by the cap member 19, ink is prevented from being dried. Further, the cap member 19 functions as an ink receiving member at the time of flushing operation.

Figure 2:
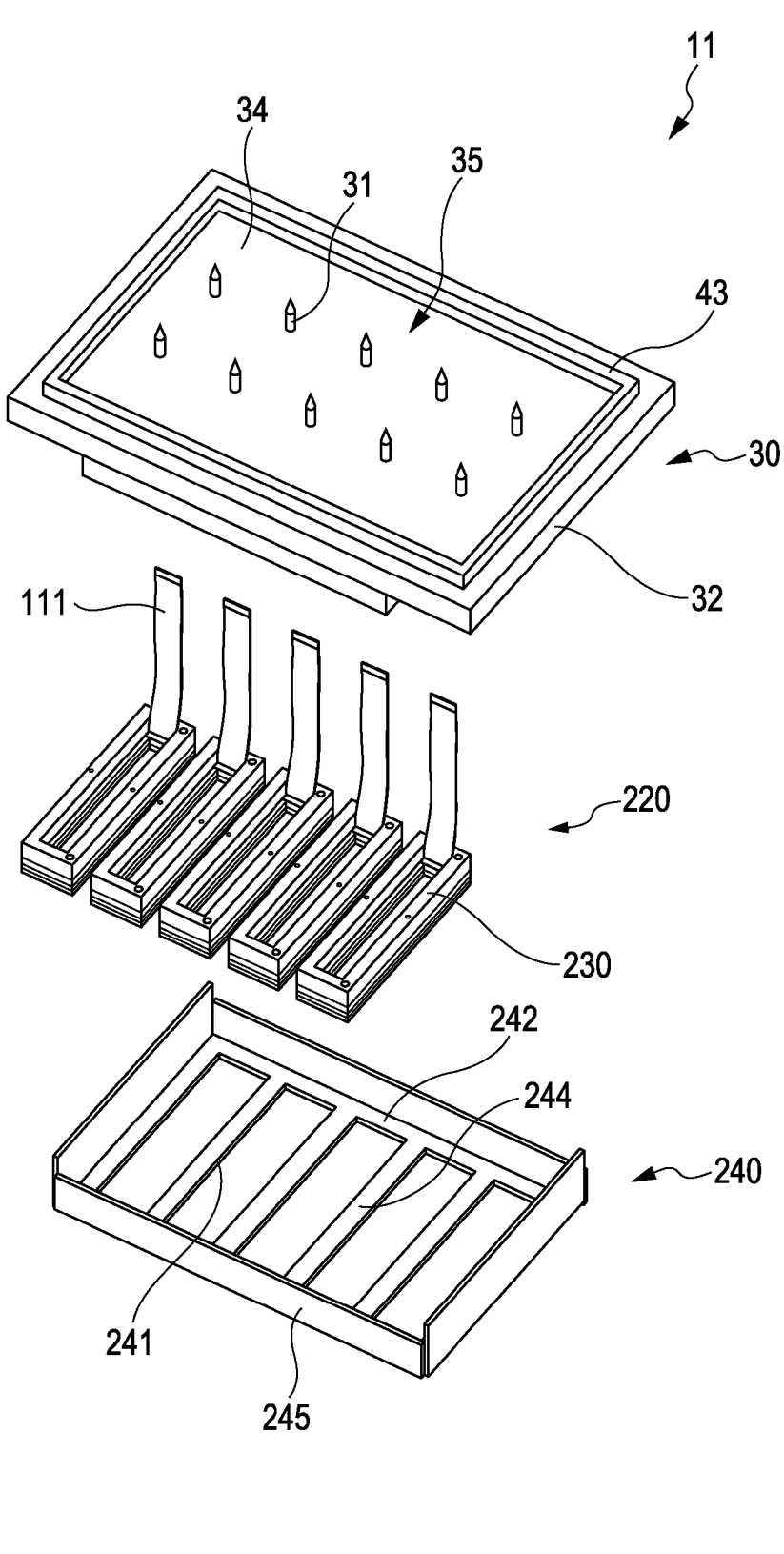
FIG. 2 is an exploded perspective view illustrating a recording head according to the first embodiment.

As illustrated in FIG. 2, the recording head 11 includes a supply member 30, head main bodies 220, and a cover head 240. The supply member 30 includes a plurality of ink supply needles 31 (first supply members), a cartridge case 32 (second supply member), and so forth. The plurality of ink supply needles 31 are inserted into the ink cartridges 13 as liquid storage units. The ink cartridges 13 are fixed to the cartridge case 32. The head main bodies 220 are fixed to a surface of the supply member 30, which is an opposite side to the ink cartridges 13. The cover head 240 is provided on the head main bodies 220 at the side of liquid ejection surfaces.

Figure 3:
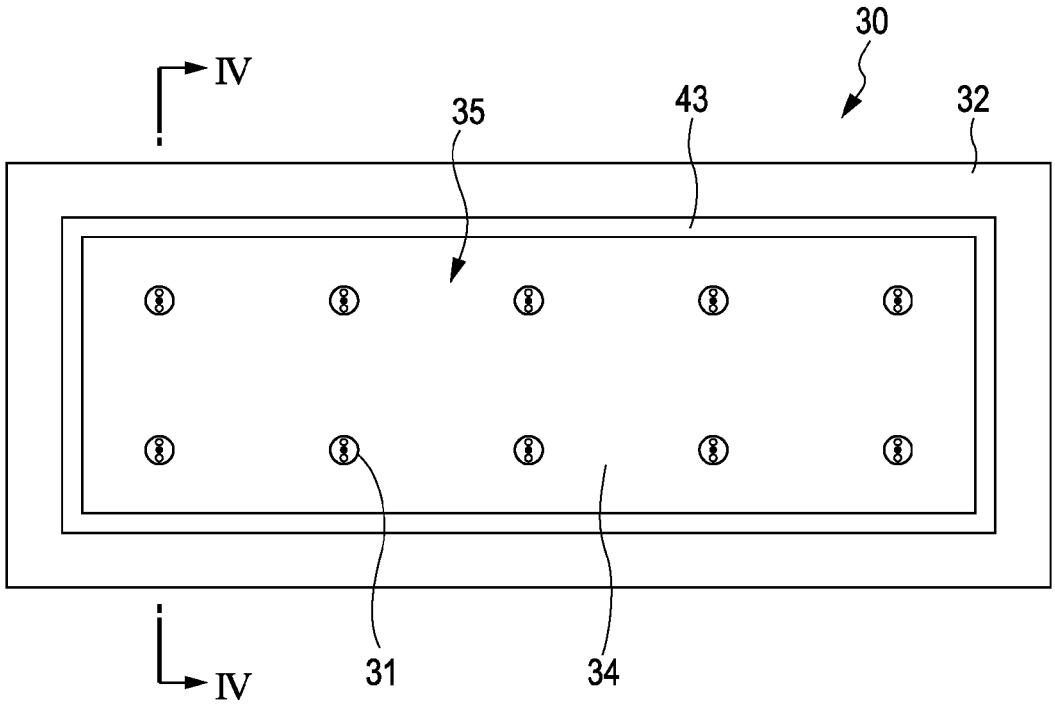
FIG. 3 is a top view illustrating a supply member according to the first embodiment.
Figure 4:
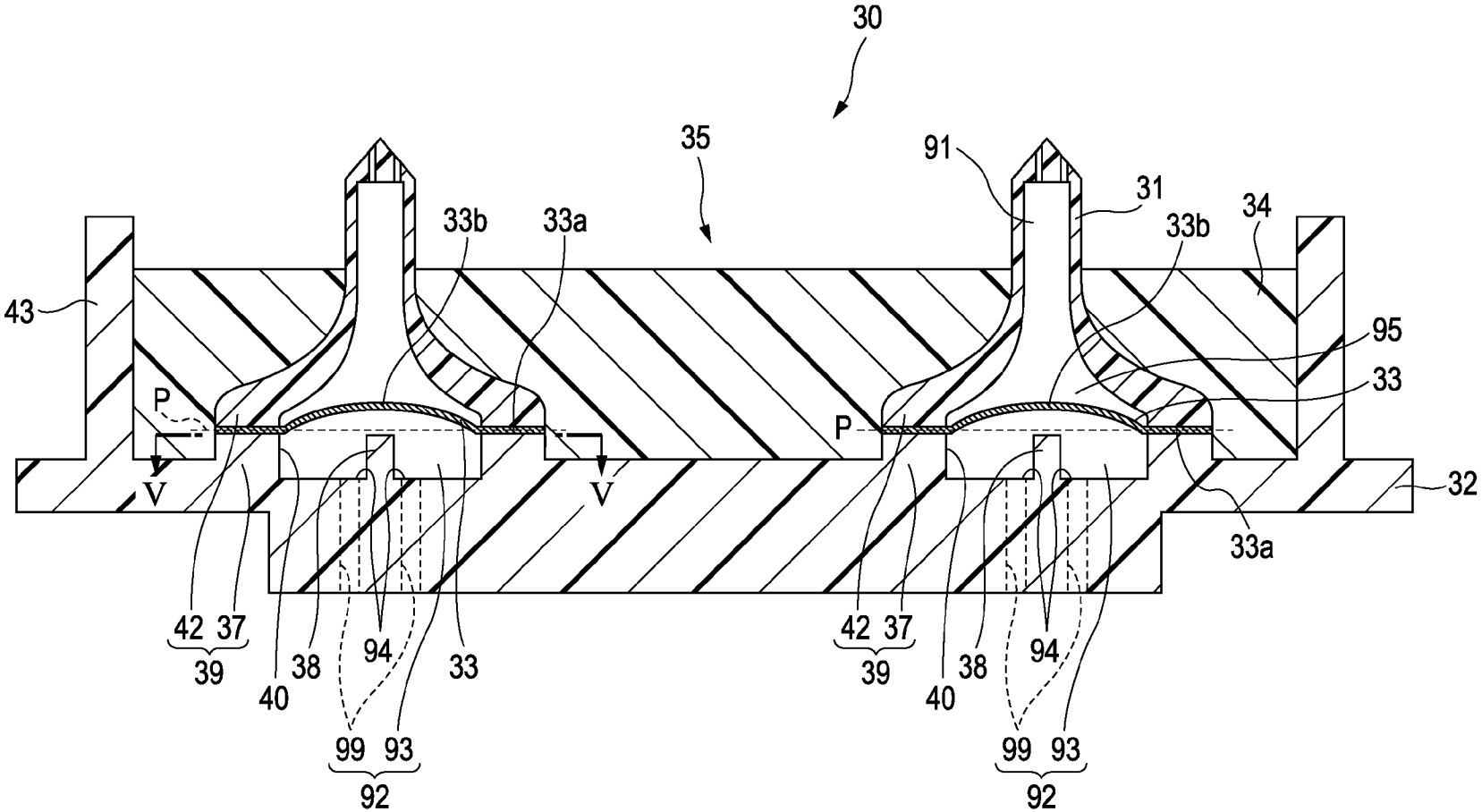
FIG. 4 is a cross-sectional view illustrating the supply member cut along a line IV-IV of FIG. 3 according to the first embodiment.

The supply member 30 will be described in further detail. FIG. 3 is a top view illustrating the supply member 30. FIG. 4 is a cross-sectional view cut along a line IV-IV of FIG. 3. As illustrated in FIG. 3 and FIG. 4, the cartridge case 32 constituting the supply member 30 has cartridge mounting portions 35 on which the ink cartridges 13 are mounted. Further, second ink supply paths 92 (second liquid supply paths) are formed on the cartridge case 32. One ends of the second ink supply paths 92 are opened to the side of the cartridge mounting portions 35 and the other ends thereof are opened to the side of the head main bodies 220. Further, the second ink supply path 92, as illustrated in FIG. 4, is constituted by, from the ink supply needle 31, a filter chamber 93 which has a constant inner diameter, a communicating supply path 99 communicating with the head main body 220 through the opening 94 on the bottom of the filter chamber 93.

Further, the ink supply needles 31 are fixed to the opening portions of the second ink supply paths 92 at the side of the cartridge mounting portions 35 on the cartridge case 32 through filters 33. First ink supply paths 91 (first liquid supply paths) are formed on the ink supply needles 31. One ends of the first ink supply paths 91 are opened to the side of the cartridge case 32 and the other ends thereof are opened to the side of the ink cartridges 13. The first ink supply paths 91 have wide portions 95 of which inner diameters are gradually decreased from the side of the cartridge case 32. It is to be noted that the first ink supply paths 91 and the second ink supply paths 92 are communicated with each other and constitute a part of ink supply paths (liquid supply paths) which connect the ink cartridges 13 and the head main bodies 220. The cartridge case 32 and the ink supply needles 31 have nip portions 39 as regions at which the filters 33 are nipped.

In the embodiment, each nip portion 39 is constituted by a filter nip portion 37 and a needle-side filter nip portion 42. The filter nip portion 37 is provided at an opening edge of the second ink supply path 92 at the side of the cartridge mounting portion 35 on the cartridge case 32. The needle-side filter nip portion 42 is provided at an opening edge of the ink supply needle 31 at the side of the cartridge case 32 so as to be opposed to the filter nip portion 37.

Further, the filter 33 is formed into a sheet form, on which a plurality of microscopic pores are formed by finely weaving metal wires, and is nipped between the first ink supply path 91 and the second ink supply path 92 on the nip portion 39 constituted by the filter nip portion 37 and the needle-side filter nip portion 42. That is to say, each filter 33 is constituted by a nipped area 33*a* in which the filter 33 is nipped by the nip portion 39 and a flow path area 33*b*. The flow path area 33*b* is an area in which the filter 33 is not nipped by the nip portion 39. That is, the flow path area 33*b* is an area in which the filter 33 is exposed to the first ink supply path 91 and the second ink supply path 92. Air bubbles and foreign matters in ink are removed with the filters 33.

In this case, the filters 33 are nipped so as to have a shape of slightly swelling up to the side of the first ink supply paths 91. It is not essential for the filters 33 to have such shapes. However, if the filters 33 have such shapes of swelling up to the side of the first ink supply paths 91, volumes of the second ink supply paths 92 at a lower side of the filters 33 can be ensured to be large.

Further, the supply member 30 includes an integral molding portion 34 which integrates the cartridge case 32, the ink supply needles 31 and the filters 33. The integral molding portion 34 integrally molds and bonds the cartridge case 32 and the ink supply needles 31 that nip the filters 33. The integral molding bonding is a bonding in which the integral molding portion 34 is molded so as to make contact with both of the cartridge case 32 and the ink supply needles 31 to bond the cartridge case 32 and the ink supply needles 31 not making use of ultrasonic welding or the like.

The cartridge case 32 and the ink supply needles 31 are integrally molded and bonded in such a manner, whereby the recording head 11 can be reduced in size. As described in further detail, when the cartridge case 32 and the ink supply needles 31 are bonded to each other not by the integral molding, the supply member 30 is manufactured by the following method. That is, the filters 33 are welded onto the cartridge case 32 by thermal welding or the like and the ink supply needles 31 are further welded by ultrasonic welding or the like. In this case, regions for welding the filters 33 need to be provided on the cartridge case 32 and regions for welding the ink supply needles 31 further need to be provided on the outer sides of the above regions.

On the other hand, in the invention, since the cartridge case 32 and the ink supply needles 31 are fixed at the integral molding portion 34, such regions for welding do not need to be provided. Therefore, spaces between adjacent ink supply needles 31 can be made shorter, whereby the recording head 11 can be reduced in size. Further, in the invention, since the recording head 11 can be reduced in size as described above, it is unnecessary that areas of the filters 33 are reduced in order to reduce the recording head 11 in size. Accordingly, the areas of the filters 33 do not need to be excessively reduced and driving voltage for driving a pressure generation unit such as piezoelectric elements 300 and heat generation elements does not need to be increased.

Figure 5:
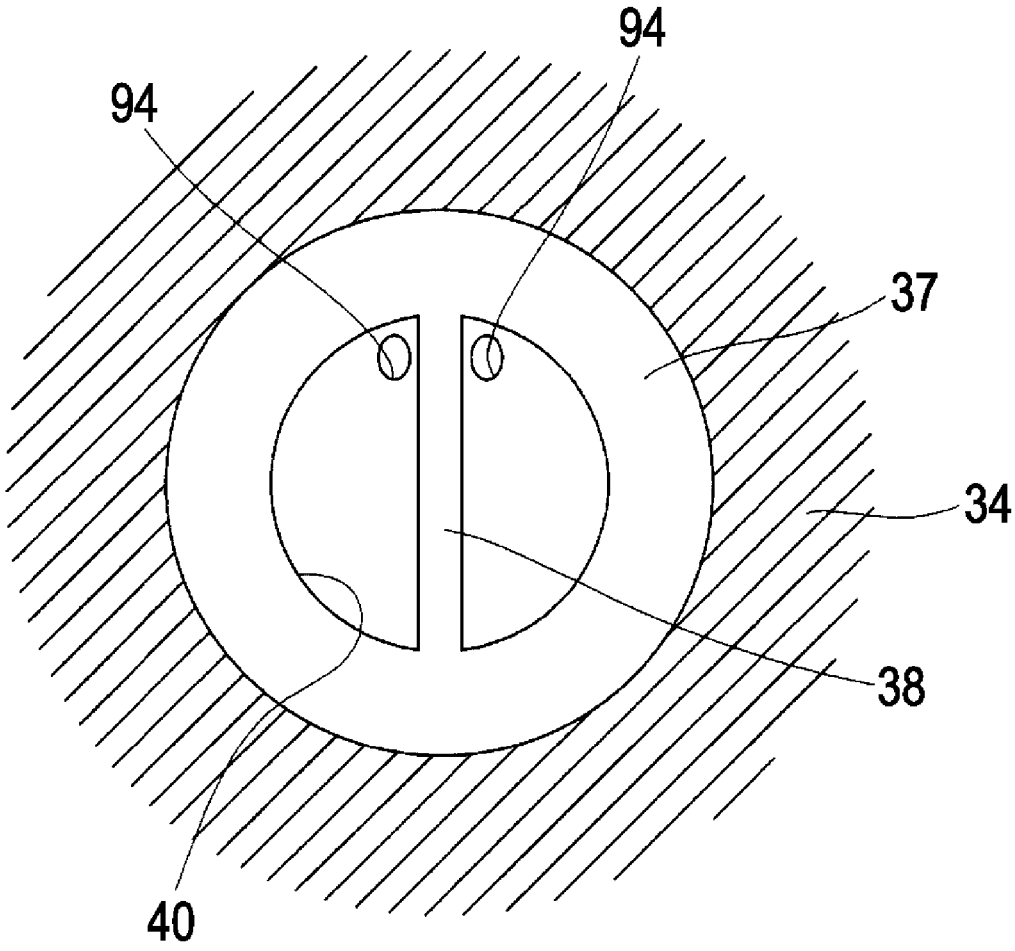
FIG. 5 is a cross-sectional view cut along a line V-V of FIG. 4.

FIG. 5 is a cross-sectional view cut along a line V-V of FIG. 4. As is clearly illustrated in FIG. 5, in the embodiment, ribs 38 are formed. Each rib 38 is arranged so as to extend to the filter chamber 93 of the second ink supply path 92 continuously from a wall 40 of the cartridge case 32 along a line passing through the center of the filter 33 in the direction perpendicular to the direction in which warpage of the integral molding portion 34 is larger. In the embodiment, two openings 94 are formed at both sides of each rib 38. The openings 94 serve as flow-in ports of ink to the communicating supply paths 99 which communicate with the head main body 220. When the two openings 94 are formed at both sides of each rib 38 as described above, ink can preferably be discharged through the two openings 94.

The ribs 38 are formed such that upper surfaces of the ribs 38 are flush with lower surfaces of the filters 33. According to the embodiment, the filters 33 do not go lower than positions of the upper surfaces of the ribs 38. Further, in this case, initial postures of the filters 33 when mounted are kept for a long period of time so that discharge performance of air bubbles can be stabilized for a long period of time.

It is to be noted that in order to make the ribs 38 be along the direction perpendicular to the direction in which warpage of the integral molding portion 34 is larger, the direction is required to be specified in advance. The direction can be appropriately specified by checking a drawing for manufacturing the supply member 30, checking the direction with a prototype, and so on. In the embodiment, a case where warpage in the short-side direction of the integral molding portion 34 is larger is described as an example. Accordingly, the ribs 38 are formed along center lines of the filters 33 in the longitudinal direction of the integral molding portion 34, which is perpendicular to the short-side direction thereof.

When the cartridge case 32 and the ink supply needles 31 are fixed by the integral molding portion 34 as described above, there has been the following existing problem. That is, each filter 33 is bent with thermal contraction after the integral molding bonding. Therefore, the filter 33 is sagged to the lower side with respect to a surface including an edge of the filter 33 nipped by the filter nip portion 37 and the needle-side filter nip portion 42 (nipped surface of the filter 33). That is, the filter 33 is sagged to the lower side with respect to a bonding surface P between the ink supply needle 31 and the cartridge case 32 (hereinafter, simply referred to as bonding surface P). This causes a problem in that air bubbles easily accumulate in the filter chamber 93.

In order to solve the above problem, in the embodiment, deformation of the filters 33 are restricted by making the lower surfaces of the filters 33 abut against the upper surfaces of the ribs 38. In such a manner, the filters 33 can be effectively prevented from being sagged to the lower side with respect to the bonding surfaces P.

Figure 12:
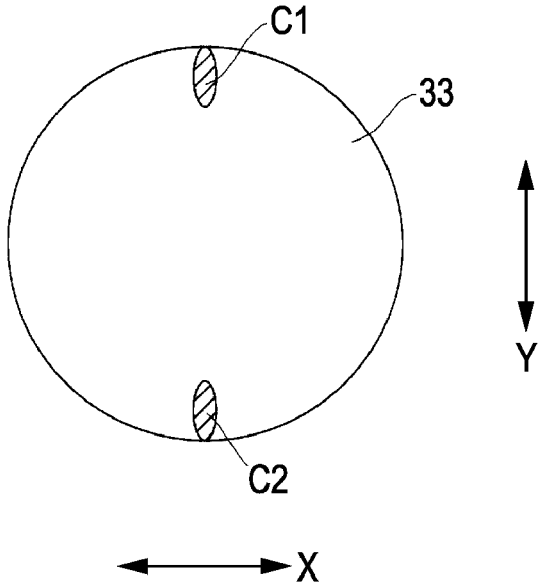
FIG. 12 is a descriptive view for explaining portions of a filter on which recesses are generated.

According to the embodiment as described above, the ribs 38 are provided so that the deformation of the filters 33 can be restricted by making the lower surfaces of the filters 33 abut against the ribs 38. In addition, according to the embodiment, the ribs 38 are provided along lines passing through the centers of the filters 33 in the direction perpendicular to the direction in which warpage of the integral molding portion 34 is larger. Therefore, the deformation of the filters 33 can be restricted more effectively. That is to say, according to the embodiment, the deformation of the filters 33 originating from recesses C1, C2 (see, FIG. 12) can be prevented by the ribs 38. As a result, narrow portions of the filter chambers 93 which are formed by the portions of the filters 33 which are sagged to the side of the filter chambers 93 due to generation of strain on the supply member 30 as a molded part can be prevented from being generated, whereby discharge performance of air bubbles can preferably be maintained.

It is to be noted that in the above-described ink jet recording head 11, in particular, the supply member 30 is manufactured with the following procedures, for example. The filters 33 are arranged between the filter nip portions 37 of the cartridge case 32 and the needle-side filter nip portions 42 of the ink supply needles 31. Further, the cartridge case 32 and the ink supply needles 31 nip the filters 33 in this state (nipping process).

Next, the cartridge case 32 and the ink supply needles 31 which nip the filters 33 are held by a mold and a space is formed by the mold, a surface of the cartridge case 32 and inner surfaces of wall portions 43. Then, a heated resin is injected into the space, and then, the resin is cured, whereby the integral molding portion 34 is formed (see, FIG. 4) (integral molding process).

Finally, the head main bodies 220 are arranged on the supply member 30 through the head cases 230 (arrangement process) and the cover head 240 is attached to cover the head main bodies 220, whereby the recording head 11 is formed (see, FIG. 2).

Figure 6:
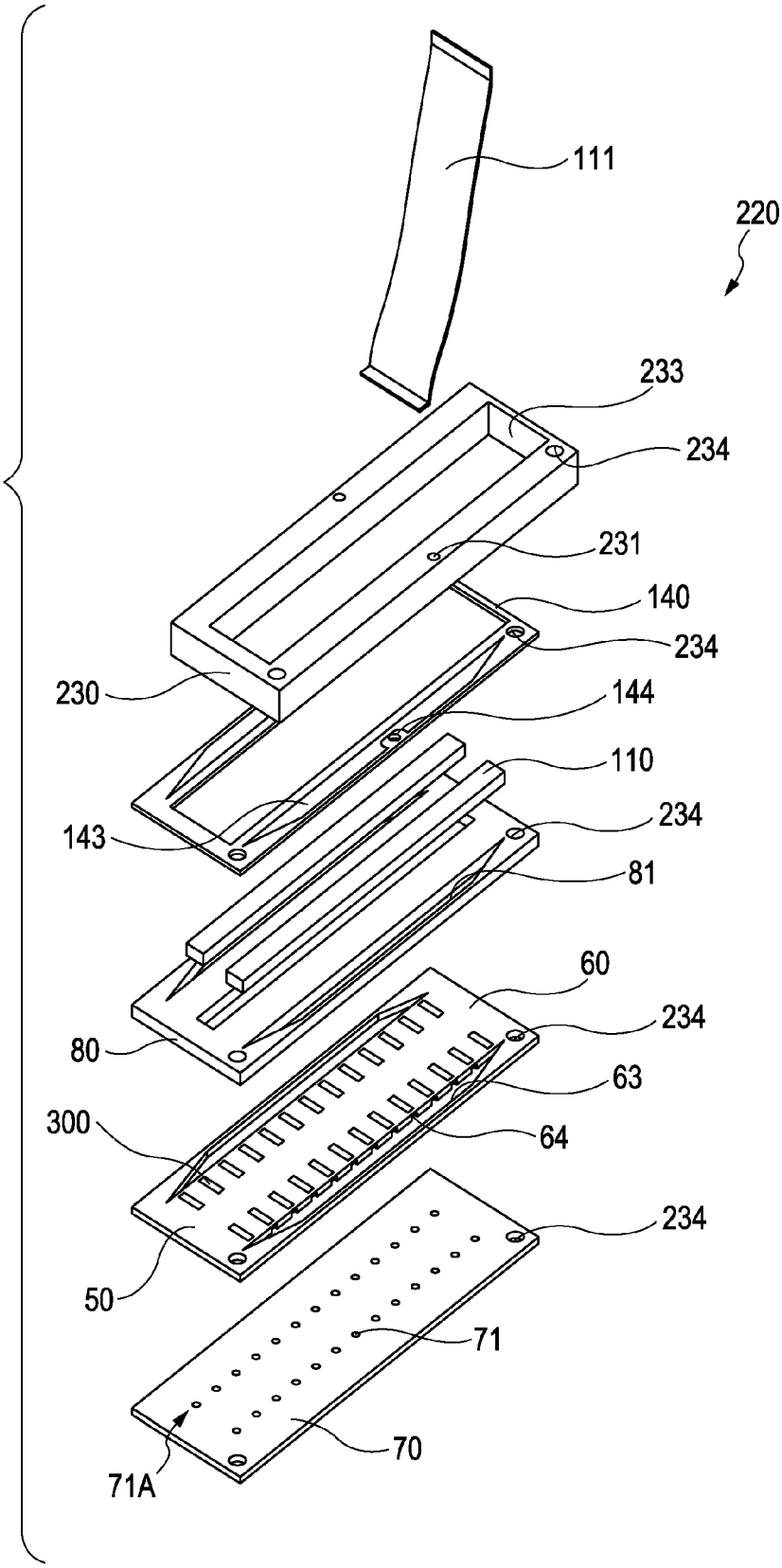
FIG. 6 is an exploded perspective view illustrating a head main body according to the first embodiment.

The head main bodies 220 are provided on the supply member 30 at an opposite side to the ink cartridges 13. Hereinafter, the head main bodies 220 are described with reference to FIG. 6 and FIG. 7. FIG. 6 is an exploded perspective view illustrating the head main body, and FIG. 7 is a cross-sectional view illustrating the head main body.

Figure 7:
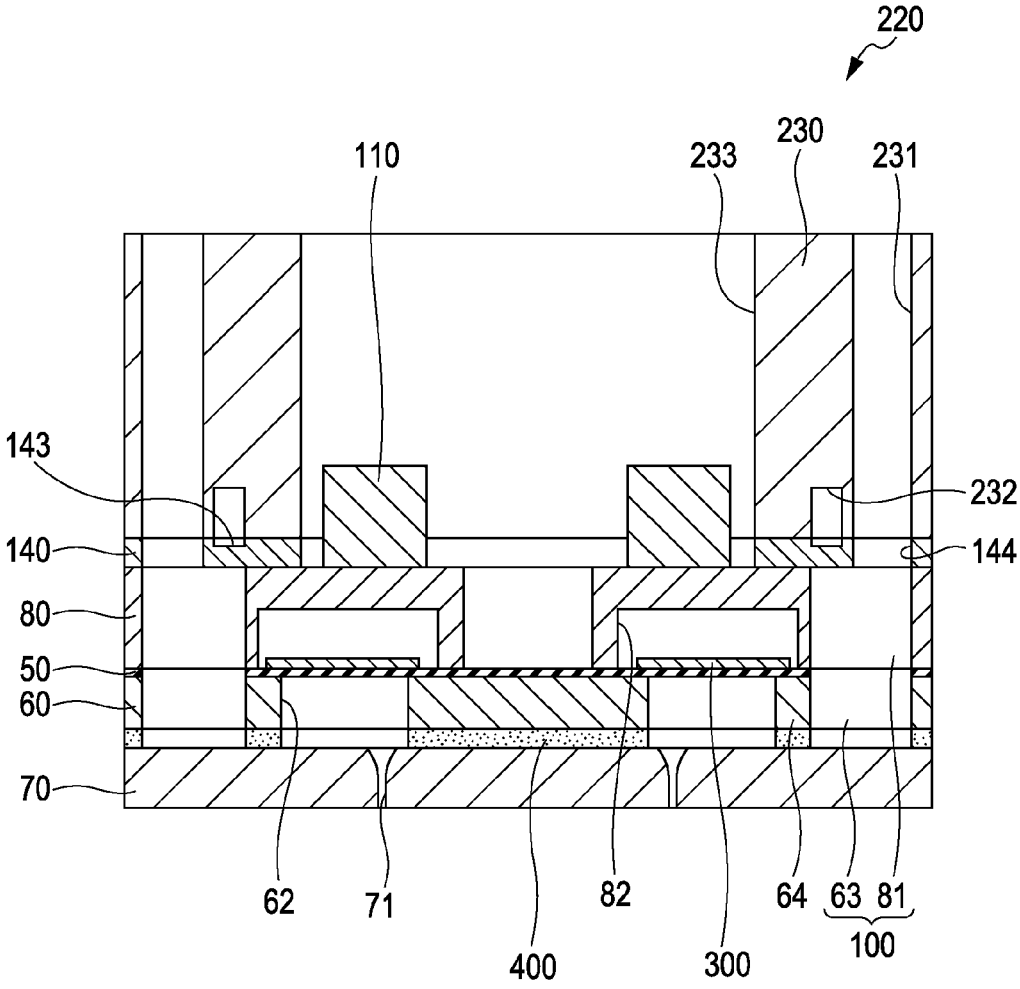
FIG. 7 is a cross-sectional view illustrating the head main body according to the first embodiment.

As illustrated in FIG. 6 and FIG. 7, a flow path formation substrate 60 constituting each head main body 220 is formed by a silicon single crystal substrate in the embodiment. An elastic film 50 made of silicon dioxide is formed on one surface of the flow path formation substrate 60. Two rows of pressure generation chambers 62 which are partitioned by a plurality of partition walls are formed on the flow path formation substrate 60 by anisotropical etching from the other surface side. The two rows of pressure generation chambers 62 are arranged in parallel in the width direction. Further, communicating portions 63 are formed on outer sides of the rows of the pressure generation chambers 62 in the longitudinal direction thereof. Each communicating portion 63 communicates with a reservoir portion 81 and constitutes a reservoir 100 serving as an ink chamber common to the pressure generation chambers 62. The reservoir portions 81 are provided on a reservoir formation substrate 80, which will be described later. Further, each communicating portion 63 is communicated with one ends of the pressure generation chambers 62 in the longitudinal direction thereof through supply paths 64. That is to say, in the embodiment, the pressure generation chambers 62, the communicating portions 63 and the supply paths 64 are provided as liquid flow paths formed on the flow path formation substrate 60.

A nozzle plate 70 on which nozzle openings 71 are formed is fixed and adhered to an opening surface side of the flow path formation substrate 60 with an adhesive 400. To be more specific, a plurality of nozzle plates 70 are provided so as to correspond to a plurality of head main bodies 220. Each of the nozzle plates 70 has an area which is slightly larger than each of exposure openings 241 (see, FIG. 2) of the cover head 240, which will be described in detail later. The nozzle plates 70 are fixed to the cover head 240 at regions at which the nozzle plates 70 overlap with the cover head 240 with an adhesive or the like. It is to be noted that the nozzle openings 71 on the nozzle plate 70 are provided in a perforating manner at positions at which the nozzle openings 71 communicate with the pressure generation chambers 62 at an opposite side to the supply paths 64. In the embodiment, since two rows of the pressure generation chambers 62 which are arranged in parallel are provided on the flow path formation substrate 60, two nozzle rows 71A of the nozzle openings 71 which are arranged in parallel are provided for one head main body 220. Further, in the embodiment, a surface of the nozzle plate 70 on which the nozzle openings 71 are opened corresponds to a liquid ejection surface. For example, a metal substrate such as a silicon single crystal substrate or a stainless steel (SUS) can be used for such nozzle plate 70.

On the other hand, piezoelectric elements 300 are formed on the elastic film 50 at an opposite side to the opening surface of the flow path formation substrate 60. A first electrode made of a metal, a piezoelectric layer made of a piezoelectric material such as lead zirconate titanate (PZT) and a second electrode made of a metal are sequentially laminated to form the piezoelectric element 300.

A reservoir formation substrate 80 is bonded onto the flow path formation substrate 60 on which such piezoelectric elements 300 are formed. The reservoir formation substrate 80 has reservoir portions 81 constituting at least a part of the reservoirs 100. In the embodiment, the reservoir portions 81 are formed across the width direction of the pressure generation chambers 62 so as to penetrate through the reservoir formation substrate 80 in the thickness direction. As described above, the reservoir portions 81 are communicated with the communicating portions 63 on the flow path formation substrate 60 so as to constitute the reservoirs 100 as ink chambers which are common to the pressure generation chambers 62.

Further, piezoelectric element holders 82 are provided on the reservoir formation substrate 80 at regions opposed to the piezoelectric elements 300. Each piezoelectric element holder 82 has a space to an extent that motions of the piezoelectric elements 300 are not hindered.

Further, driving circuits 110, each of which is formed with a semiconductor integrated circuit (IC) for driving each piezoelectric element 300, and the like, are provided on the reservoir formation substrate 80. Each terminal of the driving circuits 110 is connected to lead-out wiring which has been led out from an individual electrode of each piezoelectric element 300 through a bonding wire (not shown) or the like. Further, each terminal of the driving circuits 110 is connected to the external device through external wiring 111 such as a flexible printed circuit board (FPC) so as to receive various types of signals such as a printing signal from the external device through the external wiring 111.

In addition, a compliance substrate 140 is bonded onto the reservoir formation substrate 80. Ink introduction ports 144 for supplying ink to the reservoirs 100 are formed on the compliance substrate 140 at regions opposed to the reservoirs 100. The ink introduction ports 144 are formed so as to penetrate through the compliance substrate 140 in the thickness direction thereof. Regions other than the ink introduction ports 144 on regions of the compliance substrate 140, which are opposed to the reservoirs 100, correspond to flexible portions 143 formed to be thin in the thickness direction. The reservoirs 100 are sealed by the flexible portions 143. Compliance is given to the reservoirs 100 with the flexible portions 143.

Further, the head case 230 is fixed onto the compliance substrate 140. Ink supply communication paths 231 are provided on the head case 230. The ink supply communication paths 231 communicate with the ink introduction ports 144 and the ink supply paths of the supply member 30 to supply ink from the supply member 30 to the ink introduction ports 144. Grooves 232 are formed on the head case 230 at regions opposed to the flexible portions 143 of the compliance substrate 140 so that the flexible portions 143 are flexurally deformed appropriately. Further, a driving circuit holding portion 233 is provided on the head case 230 at a region opposed to the driving circuits 110 provided on the reservoir formation substrate 80. The driving circuit holding portion 233 penetrates through the head case 230 in the thickness direction. The external wiring 111 is inserted through the driving circuit holding portion 233 so as to be connected to the driving circuits 110.

Pin insertion holes 234 are provided at two corners on each member constituting each head main body 220. Pins for positioning each member at the time of assembly are inserted into the pin insertion holes 234. The pins are inserted to the pin insertion holes 234 so as to bond the members to each other while relatively positioning each member. With this, each head main body 220 is integrally assembled.

The head main bodies 220 which are held by the supply member 30 through the head cases 230 are relatively positioned and held by the cover head 240, as illustrated in FIG. 2. The cover head 240 has a box shape so as to cover the liquid ejection surface side of five head main bodies 220. The cover head 240 includes the exposure openings 241 and a head bonding portion 242. The nozzle openings 71 are exposed from the exposure openings 241. The head bonding portion 242 defines the exposure openings 241 and is bonded to the liquid ejection surfaces of the head main bodies 220 at both end sides of the nozzle openings 71 which are arranged in parallel on at least nozzle rows 71A.

Further, side wall portions 245 are provided on the cover head 240 at side face sides of the liquid ejection surfaces of the head main bodies 220. The side wall portions 245 are extended so as to be bent around an outer circumference of the liquid ejection surfaces.

The cover head 240 is formed such that the head bonding portion 242 is bonded to the liquid ejection surfaces of the head main bodies 220 as described above. Therefore, unevenness between the liquid ejection surfaces and the cover head 240 can be suppressed. This can prevent ink from remaining on the liquid ejection surfaces even when a wiping operation or a suction operation is performed on the liquid ejection surfaces. Further, since beam portions 244 partition adjacent head main bodies 220 from each other in a sealing manner, ink does not enter between the adjacent head main bodies 220. This makes it possible to prevent the piezoelectric elements 300, the driving circuits 110, and the like from being deteriorated or damaged due to ink. Further, the liquid ejection surfaces of the head main bodies 220 and the cover head 240 are bonded to each other with an adhesive with no space therebetween. Therefore, the recording medium S is prevented from entering the space between the liquid ejection surfaces and the cover head 240, whereby deformation of the cover head 240 and occurrence of paper jam can be prevented. In addition, the side wall portions 245 cover the outer circumference of the plurality of head main bodies 220 so that ink can reliably be prevented from running around to side surfaces of the head main bodies 220. Further, the head bonding portion 242 which is bonded to the liquid ejection surfaces of the head main bodies 220 is provided on the cover head 240. Therefore, the liquid ejection surfaces can be bonded while each nozzle row 71A on the plurality of the head main bodies 220 is positioned with respect to the cover head 240 with high accuracy.

The cover head 240 is made of a metal material such as a stainless steel, for example. The cover head 240 may be formed by pressing a metal plate or may be formed by molding. Further, if the cover head 240 is made of a conductive metal material, the cover head 240 can be grounded. It is to be noted that a method of bonding the cover head 240 and the nozzle plates 70 is not particularly limited. For example, the cover head 240 and the nozzle plates 70 may be adhered to each other with a thermosetting epoxy-based adhesive, an ultraviolet curable adhesive, or the like.

In the ink jet recording head 11 according to the embodiment, ink is taken from the ink cartridges 13 through the first ink supply paths 91 and the second ink supply paths 92. Then, an inner portion from the reservoirs 100 to the nozzle openings 71 is filled with ink through the ink supply communicating paths 231 and the ink introduction ports 144. Thereafter, voltage is applied to each of the piezoelectric elements 300 corresponding to each of the pressure generation chambers 62 in accordance with a recording signal from the driving circuits 110 so as to cause the elastic film 50 and the piezoelectric elements 300 to deform flexurally. Therefore, pressures in the pressure generation chambers 62 are increased so that ink droplets are discharged through the nozzle openings 71.

Second Embodiment

Figure 8:
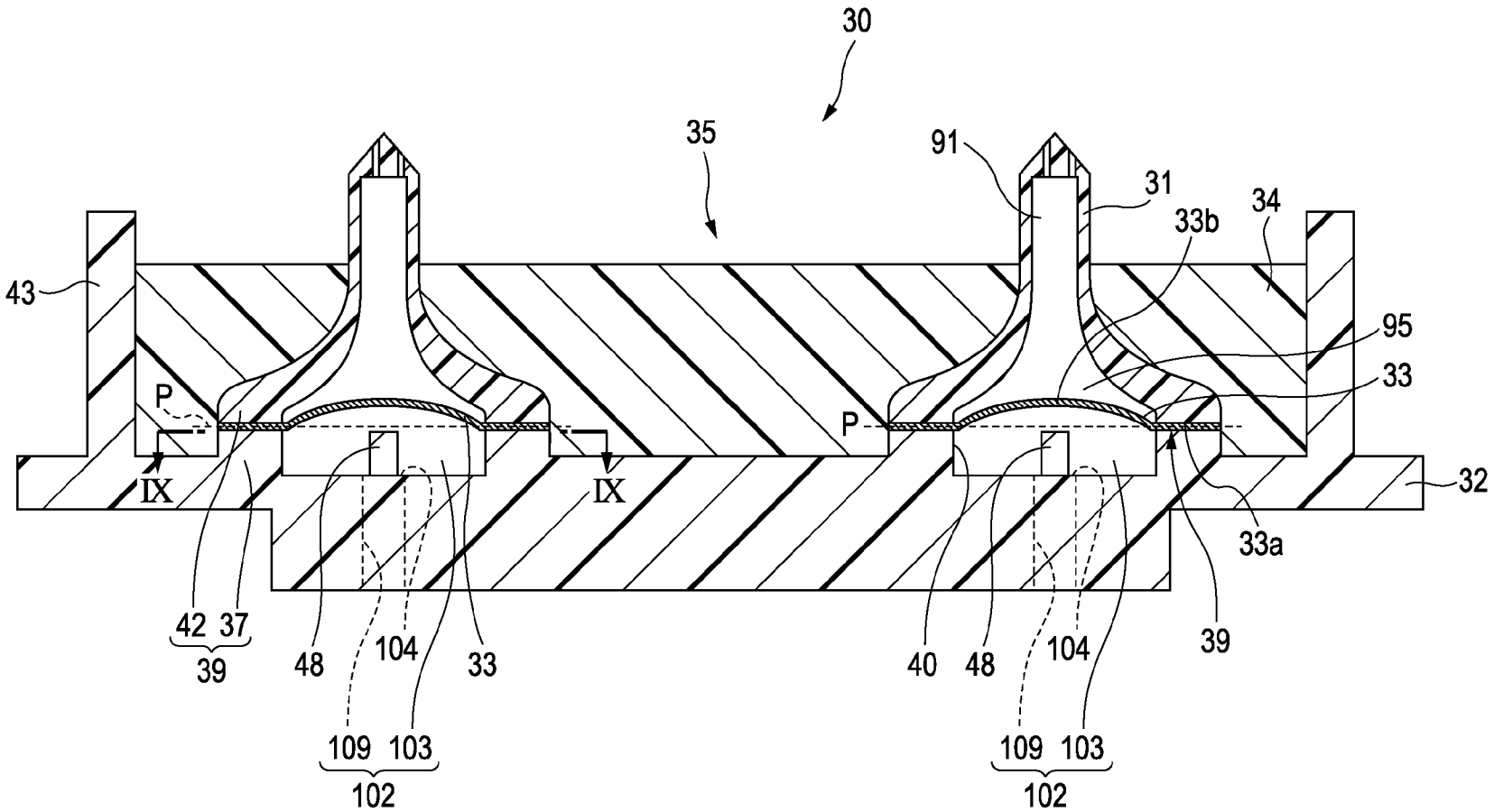
FIG. 8 is a cross-sectional view illustrating a portion corresponding to a cross section cut along a line VIII-VIII of FIG. 3 according to a second embodiment.
Figure 9:
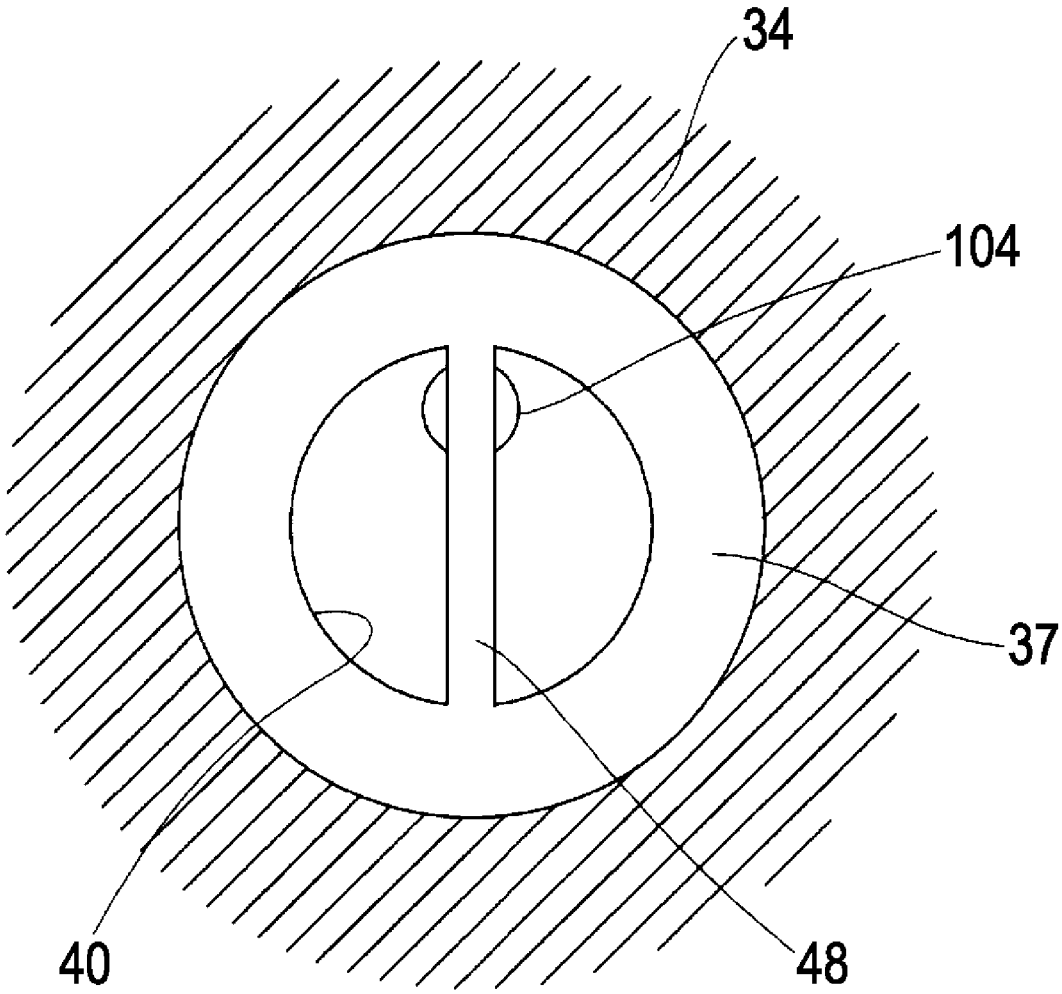
FIG. 9 is a cross-sectional view illustrating a portion corresponding to a cross section cut along a line IX-IX of FIG. 8.

FIG. 8 is a cross-sectional view illustrating a portion corresponding to a cross section cut along a line VIII-VIII of FIG. 3 according to the embodiment. FIG. 9 is a cross-sectional view illustrating a cross section cut along a line IX-IX of FIG. 8. It is to be noted that in FIG. 8 and FIG. 9, the same reference numerals denote the same portions as those in FIG. 3 and FIG. 4 and the duplicate description thereof is omitted.

As illustrated in FIG. 8 and FIG. 9, each rib 48 is formed along the line passing through the center of the filter 33 and along the direction (in the embodiment, longitudinal direction of the integral molding portion 34) perpendicular to the direction in which warpage of the integral molding portion 34 is larger. An opening 104 of a second ink supply path 102 formed by a filter chamber 103 and a communicating supply path 109 is formed on a lower portion of the center of the rib 48.

As a result, in the embodiment, ink flowing into the filter chamber 103 is collected to one opening 104 from both sides of the rib 48. Therefore, ink can be appropriately supplied to the head main body 220 through the communicating supply path 109 in a predetermined manner. At the same time, as in the first embodiment, a position of the lower surface of the filter 33 is restricted by the rib 48 so as to preferably prevent the deformation of the filter 33, whereby preferable discharge performance of air bubbles can be obtained.

Third Embodiment

Figure 10:
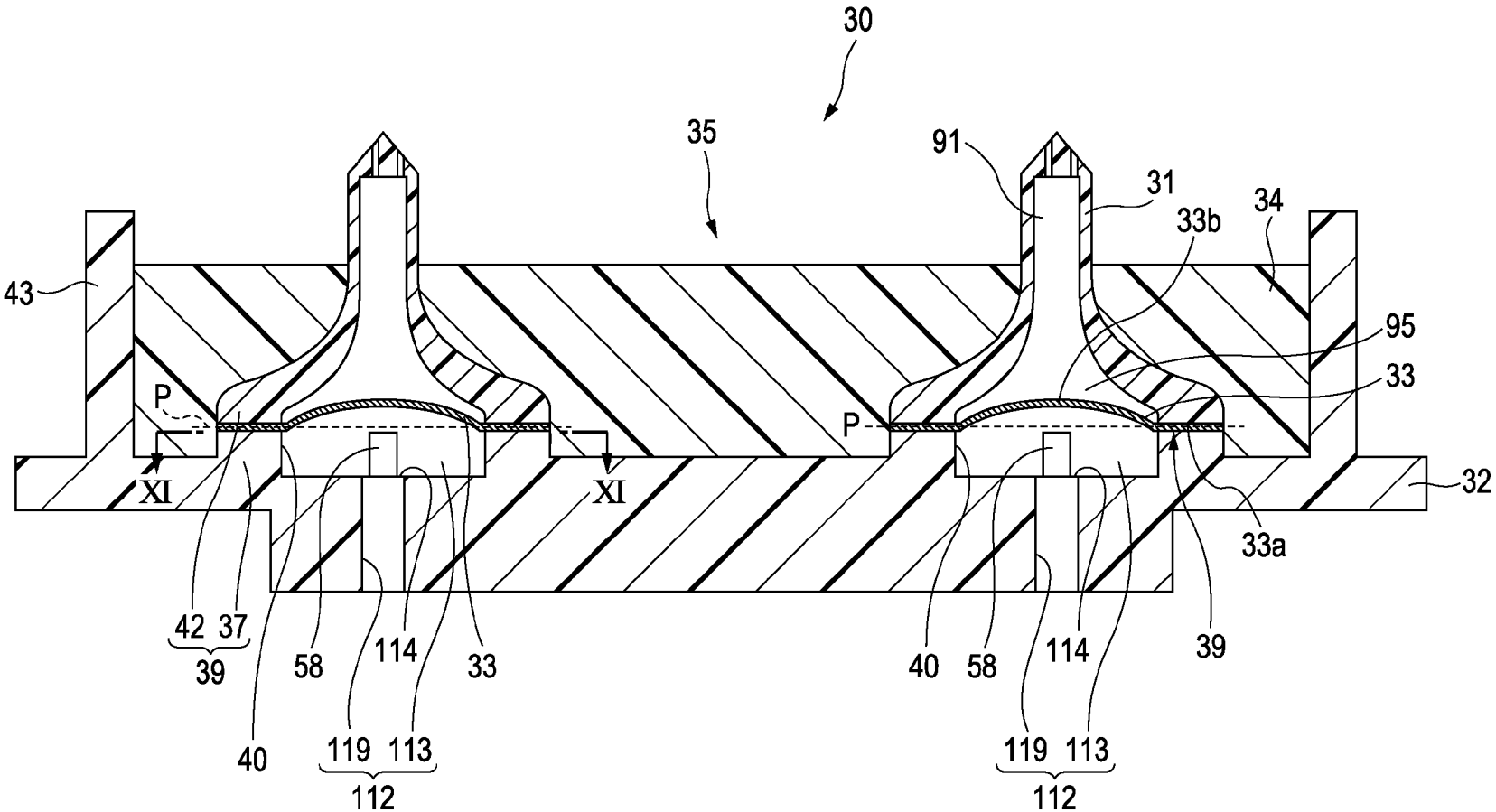
FIG. 10 is a cross-sectional view illustrating a portion corresponding to a cross section cut along a line X-X of FIG. 3 according to a third embodiment.

FIG. 10 is a cross-sectional view illustrating a portion corresponding to a cross section cut along a line X-X of FIG.

Figure 11:
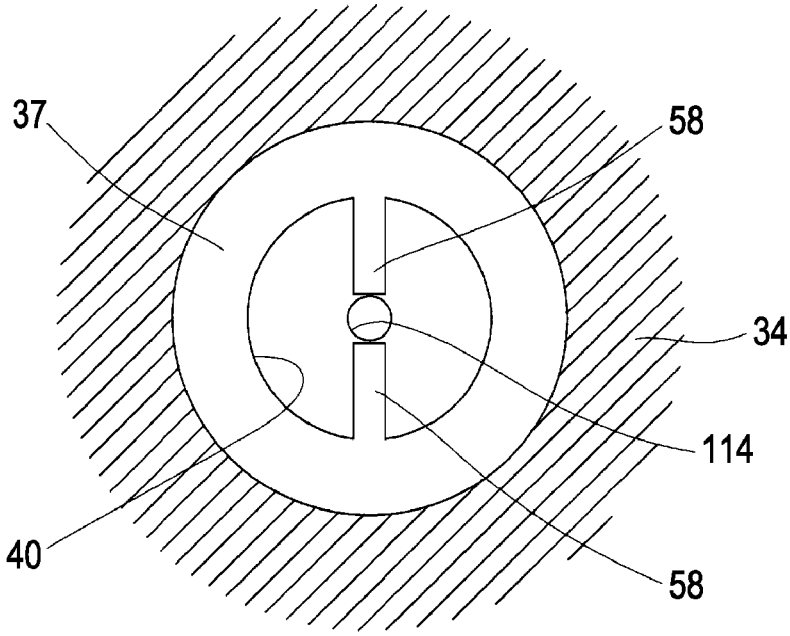
FIG. 11 is a cross-sectional view illustrating a portion corresponding to a cross section cut along a line XI-XI of FIG. 10.

3 according to the embodiment. FIG. 11 is a cross-sectional view cut along a line XI-XI of FIG. 10. It is to be noted that in FIG. 10 and FIG. 11, the same reference numerals denote the same portions as those in FIG. 3 and FIG. 4 and the duplicate description thereof is omitted.

As illustrated in FIG. 10 and FIG. 11, each rib 58 is provided from the wall 40 to an edge of an opening 114 along th line passing through the center of the filter 33 and along the direction (in the embodiment, longitudinal direction of the integral molding portion 34) perpendicular to the direction in which warpage of the integral molding portion 34 is larger. That is to say, the rib 58 is divided into two and each divided rib 58 extends from the wall 40 to the edge of opening 114. The opening 114 is formed at the center of a second ink supply path 112 formed by a filter chamber 113 and a communicating supply path 119.

Thus, in the embodiment, the rib 58 is not formed on the opening 114. Therefore, ink flows into the communicating supply path 119 through the opening 114 smoothly. That is to say, ink flowing into the filter chamber 113 is collected to the opening 114 at the center so as to be appropriately supplied to the head main body 220 through the communicating supply path 119. At this time, in the embodiment, as in the first and second embodiments, a position of the lower surface of the filter 33 is restricted by the rib 58 so as to preferably prevent the deformation of the filter 33, whereby preferable discharge performance of air bubbles can be obtained.

Other Embodiments

In each of the above embodiments, a single recording head 11 constituted by the plurality of head main bodies 220 as one unit has been described. However, a recording head unit obtained by integrally forming the plurality of recording heads 11 can be configured. As such recording head unit, a recording head unit in which the recording heads 11 are arranged in a zigzag form in the nozzle row direction can be considered. The recording head unit can also be configured to be mounted on the carriage 12 in the same manner as the recording head 11.

Further, in each of the above embodiments, the ink cartridges 13 are connected directly to the ink supply needles 31 in a detachable manner. However, a configuration is not limited thereto. For example, a configuration in which supply pipes made of flexible tubes (not shown) are arranged between the ink cartridges 13 and the ink supply needles 31 and inks from the ink cartridges which are arranged to be spaced from the ink supply needles are supplied to the ink supply needles through the supply pipes may be employed.

In each of the above embodiments, the filters 33 having circular shapes are employed. However, the shapes of the filters 33 are not limited thereto. For example, the filters 33 may have elliptical shapes (oval shapes). This is because it is sufficient that positions at which the recesses C1, C2 are formed can be specified from a relationship with the warpage direction of the supply member 30. That is to say, it is highly possible that the recesses C1, C2 are formed on ends of the filters 33 in the direction perpendicular to the direction in which the warpage is larger and deformation of the filters 33 may easily be generated originating from the recesses C1, C2. Accordingly, it is sufficient that the ribs are formed along straight lines connecting the recesses C1, C2 as described above.

Further, in each of the above embodiments, after the filters 33 are nipped by the ink supply needles 31 and the cartridge case 32, the ink supply needles 31 and the cartridge case 32 are integrally molded and bonded by the integral molding portion 34. However, a configuration is not limited thereto as long as the filters 33, the ink supply needles 31 and the cartridge case 32 are integrally molded and bonded. For example, a configuration in which the filters 33 are welded onto the cartridge case 32, and then, the cartridge case 32 onto which the filters 33 have been welded and the ink supply needles 31 are integrally molded and bonded by the integral molding portion 34 may be employed.

Further, in each of the above embodiments, each of the filters 33 is formed into a sheet form by finely weaving metal wires. However, a configuration of the filters 33 is not limited thereto. For example, each filter 33 may be formed into a sheet form by punching out a metal plate. Alternatively, each filter 33 may be made of a resin having microscopic pores and formed into a sheet form.

In each of the above embodiments, the ink cartridges 13 as liquid storage units are provided on the supply member 30 in a detachable manner. However, a configuration of the ink cartridges 13 is not limited thereto. For example, a configuration in which ink tanks or the like are provided as liquid storage units at different positions from the recording head 11 and the liquid storage units and the recording head 11 are connected to each other through supply pipes such as tubes may be employed. That is to say, in each of the above embodiments, the needle-form ink supply needles 31 are described as examples of the first supply members. However, the first supply member is not limited to be a needle form.

Further, in each of the above embodiments, a configuration in which one head main body 220 is provided for two liquid supply paths is described. However, a configuration in which a plurality of head main bodies are provided for each color of ink may be employed. In such a case, each liquid supply path communicates with each head main body. That is to say, each liquid supply path may be provided so as to communicate with each nozzle row on which nozzle openings are arranged in parallel on each head main body. It is needless to say that the liquid supply path may not communicate with each nozzle row and one liquid supply path may communicate with a plurality of nozzle rows. Alternatively, one nozzle row may be divided into two and each divided nozzle row may communicate with a liquid supply path. That is to say, it is sufficient that the liquid supply path communicate with a nozzle opening group formed of a plurality of nozzle openings.

In addition, in each of the above embodiment, the invention has been described by using the ink jet recording head 11 which ejects ink droplets as an example. However, the invention is widely aimed at liquid ejecting heads in general. As other liquid ejecting heads, various types of recording heads used for image recording apparatuses such as a printer, color material ejecting heads used for manufacturing a color filter such as a liquid crystal display, electrode material ejecting heads used for forming electrodes such as an organic EL display and a field emission display (FED), bioorganic compound ejecting heads used for manufacturing a bio chip, and the like are exemplified.

What is claimed is:

1. A liquid ejecting head comprising:

a head main body which ejects liquid supplied from a liquid storage unit through a liquid supply path;

a first supply member on which a first liquid supply path constituting a part of the liquid supply path is provided;

a second supply member on which a second liquid supply path communicating with the first liquid supply path to constitute a part of the liquid supply path is provided and which supplies the liquid to the head main body;

a filter which is nipped between the first liquid supply path and the second liquid supply path;

an integral molding portion which integrally molds and bonds the first supply member and the second supply member;

a rib which is arranged so as to extend into the second liquid supply path continuously from a wall of the second supply member along a line passing through a center of the filter in the direction perpendicular to the direction in which warpage of the integral molding portion is largest; and an opening of a flow path disposed at the center of the rib.

2. The liquid ejecting head according to claim 1, wherein the rib is provided from the wall to an edge of the opening.

3. A liquid ejecting head unit comprising a plurality of liquid ejecting heads, the plurality of liquid ejecting heads comprising the liquid ejecting head according to claim 2.

4. A liquid ejecting apparatus comprising the liquid ejecting head according to claim 2.

5. The liquid ejecting head according to claim 1, wherein an upper surface of the rib is formed so as to be flush with a surface of the filter which faces the second liquid supply path.

6. A liquid ejecting head unit comprising a plurality of liquid ejecting heads, the plurality of liquid ejecting heads comprising the liquid ejecting head according to claim 5.

7. A liquid ejecting apparatus comprising the liquid ejecting head according to claim 5.

8. A liquid ejecting head unit comprising a plurality of liquid ejecting heads, the plurality of liquid ejecting heads comprising the liquid ejecting head according to claim 1.

9. A liquid ejecting head unit comprising a plurality of liquid ejecting heads, the plurality of liquid ejecting heads comprising the liquid ejecting head according to claim 1.

10. A liquid ejecting apparatus comprising the liquid ejecting head according to claim 1.

11. A liquid ejecting apparatus comprising the liquid ejecting head according to claim 1.

12. A liquid ejecting head comprising:

a head main body which ejects liquid supplied from a liquid storage unit through a liquid supply path;

a first supply member on which a first liquid supply path constituting a part of the liquid supply path is provided;

a second supply member on which a second liquid supply path communicating with the first liquid supply path to constitute a part of the liquid supply path is provided and which supplies the liquid to the head main body;

a filter disposed between the first liquid supply path and the second liquid supply path;

an integral molding portion which integrally molds and bonds the first supply member and the second supply member; and a rib attached to the second supply member and extending into the second liquid supply path continuously from a wall of the second supply member along a line passing through a center of the filter in the direction perpendicular to the direction in which warpage of the integral molding portion is largest; and an opening of a flow path disposed at the center of the rib.

13. The liquid ejecting head according to claim 12, wherein an upper surface of the rib is flush with a surface of the filter which faces the second liquid supply path.

14. The liquid ejecting head according to claim 12, wherein the rib is configured to restrict deformation of the filter when the filter abuts against a surface of the rib.

* * * * *